US006132283A

United States Patent [19]

O'Donnell et al.

[11] Patent Number: 6,132,283

[45] Date of Patent: Oct. 17, 2000

[54] INFANT STIMULUS TOY APPARATUS

[76] Inventors: Teresa Hohol O'Donnell; Patrick Alan O'Donnell, both of 16 Margaret La., Billerica, Mass. 08121-2965

[21] Appl. No.: 09/088,273

[22] Filed: Jun. 1, 1998

[51] Int. Cl.[7] ..... A63H 33/38; G09F 19/08; G09F 5/00

[52] U.S. Cl. ..... 446/227; 434/247; 434/258; 434/259; 434/429; 434/430; 40/574; 40/611; 40/714; 40/605; 40/705; 40/777; 40/735

[58] Field of Search ..... 446/227; 434/247, 434/258, 259, 429, 430; 40/574, 611, 714, 605, 705, 777, 735

[56] References Cited

U.S. PATENT DOCUMENTS

| | | | |
|---|---|---|---|
| 100,962 | 3/1870 | Adams . | |
| 3,813,799 | 6/1974 | Caravello | 40/152 |
| 4,034,496 | 7/1977 | Cohen | 40/152 |
| 4,202,122 | 5/1980 | Namiki | 40/158 |
| 4,899,473 | 2/1990 | Wiener | 40/152 |
| 4,960,383 | 10/1990 | Smith | 434/430 |
| 5,313,724 | 5/1994 | Warner | 40/152 |
| 5,523,930 | 6/1996 | Fritts | 362/223 |
| 5,555,654 | 9/1996 | Hermann | 40/714 |
| 5,709,582 | 1/1998 | O'Donnell | 446/227 |
| 5,758,442 | 6/1998 | Flanigan | 40/624 |

*Primary Examiner*—Kien T. Nguyen
*Assistant Examiner*—Kevin Hughes
*Attorney, Agent, or Firm*—S. Michael Bender

[57] ABSTRACT

A toy apparatus includes a back housing portion which includes straps for connecting the apparatus to a crib. A plurality of item pressing members are connected to an interior portion of the back housing portion. A front housing portion includes a housing connector for connecting the front housing portion to the back housing portion. The front housing portion includes a plurality of item retainers and a plurality of windows placed in registration with the item retainers. A plurality of infant stimulus items are retained in the item retainers. The item retainers are placed in registration with the item pressing members when the front housing portion and the back housing portion are placed in a closed orientation. A housing lock assembly is connected between the back housing portion and the front housing portion, for keeping the back housing portion and the front housing portion closed with respect to each other. The infant stimulus items can include stimulus cards which include grab tabs located on back sides of the stimulus cards. The housing connector includes a hinge connected between an edge of the back housing portion and a complementary edge of the front housing portion. An electrical power and distribution system is supported by the back housing portion. The electrical power and distribution system includes a battery power supply, electrical conductors, and electrical contacts for powering electrical items used in the apparatus. A lock-enabled electrical switch is located in series in the electrical power and distribution system.

22 Claims, 7 Drawing Sheets

26
34
34'
26
17
18
12
38
39
38
38
75
38
21
6
40

34
26
34'
26
38
12
38
38
39
75
38
21
40
39
17
16
18
17
22
39
38
39

FIG 7
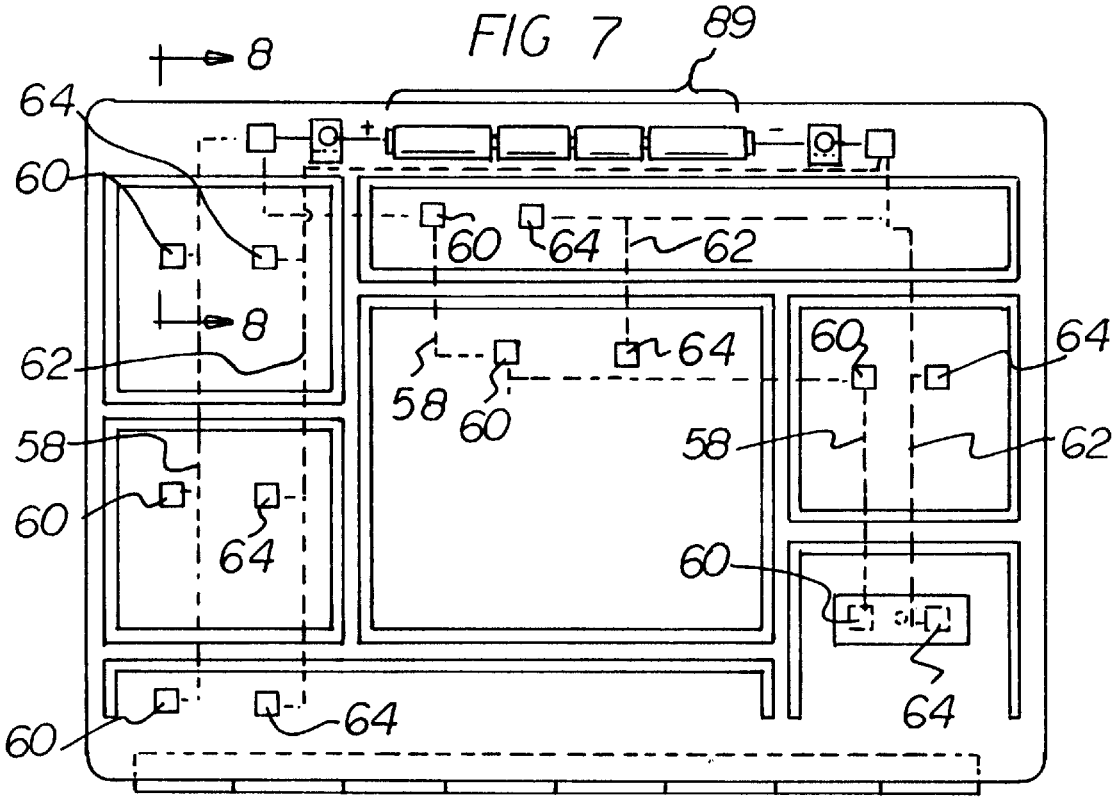
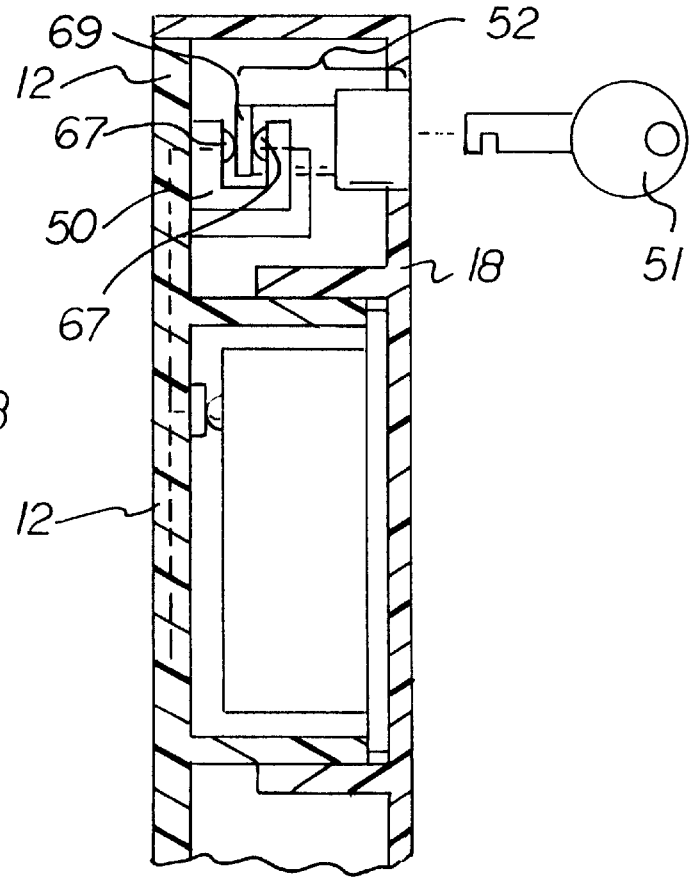
FIG 8

FIG 11
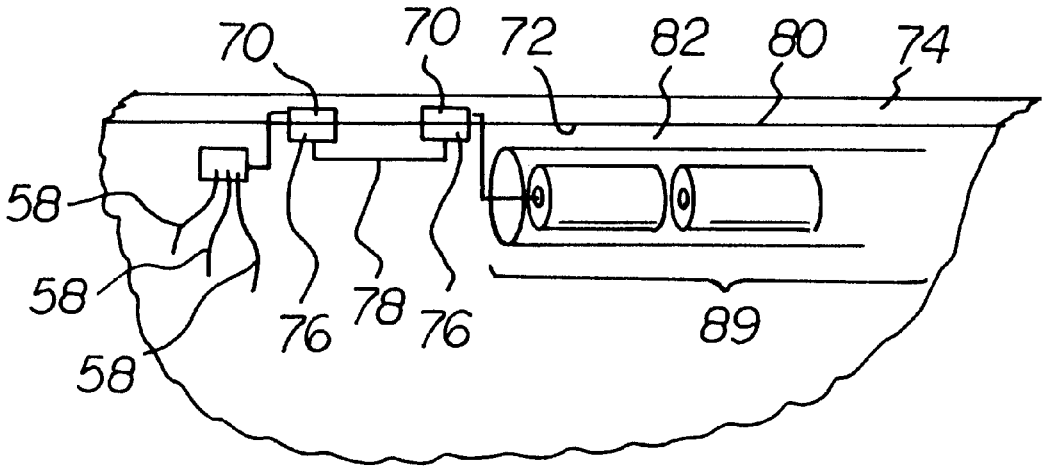
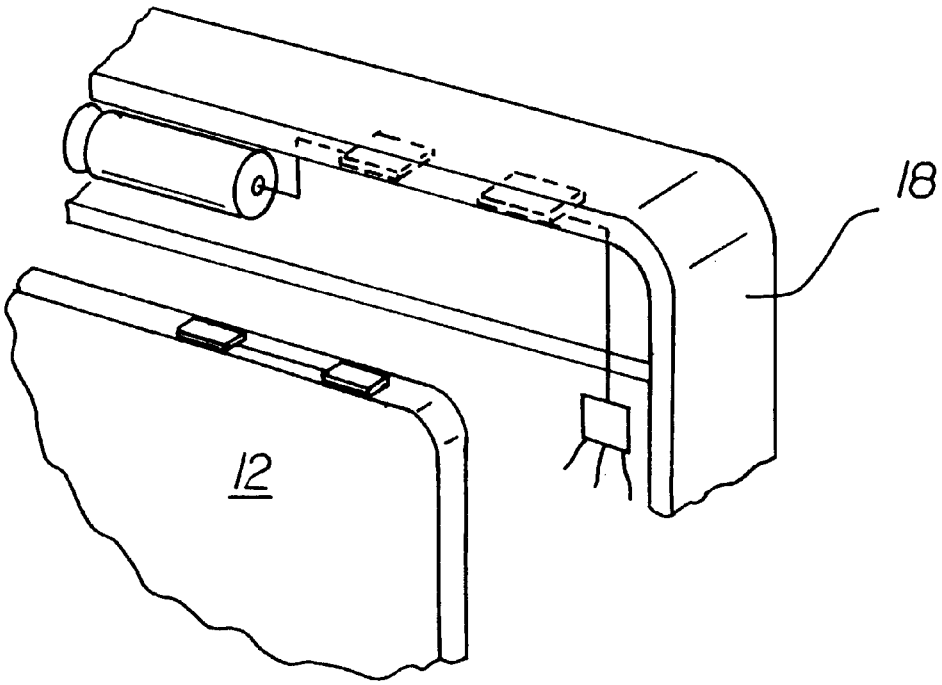
FIG 12

INFANT STIMULUS TOY APPARATUS

BACKGROUND OF THE INVENTION

1. Field of the Invention

The present invention relates generally to toys and, more particularly, to toys especially adapted for stimulating infants.

2. Description of the Prior Art

A useful and effective infant stimulus toy apparatus is disclosed in U.S. Pat. No. 5,709,582 by the same inventor herein, and that patent is incorporated herein by reference. Subsequent to the development of the infant stimulus toy apparatus set forth in U.S. Pat. No. 5,709,582, the present inventor has made improvements thereof.

More specifically, with the device disclosed in U.S. Pat. No. 5,709,582, stimulus cards are inserted in the rear portion of the device. However, to permit the use of toys or other bulky stimulus items and to provide a safer device, it would be desirable if stimulus items were placed in the front portion of the device.

With the device in U.S. Pat. No. 5,709,582, stimulus cards are secured by a set of three right-angle brackets which provide a relatively loose fit on the stimulus cards. In this respect, it would be desirable if a device provides a tight fit on stimulus cards.

When an infant lies on one's back in a crib a stimulus card which is oriented vertically may not be easily viewed by the infant In this respect, it would be desirable if a device were provided which tilts stimulus cards downward to enable infants laying down in a crib to see the stimulus cards.

With the device in U.S. Pat. No. 5,709,582, stimulus cards have smooth back surfaces which are not exposed when the card is mounted in its slots. In order to remove stimulus cards from such a device, a person must grasp an edge of a card or the front of the card, which may prove difficult to accomplish. Repeated grasping of card edges or fronts may result in fraying the card edges or damage to the toys or pictures on the front of the cards. In this respect, it would be desirable if a device were provided in which removal of the stimulus cards is facilitated without requiring the edges or front of the card to be grasped.

There are a wide variety of electronic devices that have considerable entertainment value. The device in U.S. Pat. No. 5,709,582 has no special provision for powering electronic devices. Of course, electronic devices that have independent power supplies can be used with the device in U.S. Pat. No. 5,709,582. Yet, the different batteries in different electronic devices can be in various states of charge. This may lead to confusion as to which batteries will provide adequate power and which batteries will not. In addition, duplicate batteries in each electronic toy increases the cost of using the device for the end consumer, which makes the device less desirable. To overcome these disadvantages, a common power supply for all of the electronic devices could be provided. In this respect, it would be desirable if a central power supply were provided for all electronic devices that are employed in an infant stimulus toy apparatus.

Once battery-containing infant stimulus toy apparatus is opened, to prevent battery discharge and to prevent electrical shocks, it would be desirable if a device were provided which prevents the batteries from discharging.

With the device disclosed in U.S. Pat. No. 5,709,582, the device can be opened by manually actuating push buttons or the like. In this respect, an infant may be able to manually open such a device and damage the stimulus cards. To avoid such an occurrence, it would be desirable if an infant stimulus toy device were provided which requires to use of some sort of removable key to open the device.

Thus, while U.S. Pat. No. 5,709,582 indicates it to be well known to use an infant stimulus toy apparatus, said patent does not teach or suggest an improved infant stimulus toy apparatus which has the following combination of desirable features: (1) places stimulus items in the front portion of the device; (2) provides a tight fit on stimulus cards when the device is closed; (3) can tilt stimulus items downward to enable infants laying down in a crib to see the stimulus items; (4) provides a device in which stimulus cards can be removed without grasping the edges or fronts of the cards; (5) provides a central power supply and distribution system for all electronic devices that are employed in the device; (6) prevents batteries from discharging once an infant stimulus toy apparatus is opened; and (7) requires to use of some sort of removable key to open the device. The foregoing desired characteristics are provided by the unique improved infant stimulus toy apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a toy apparatus which includes a back housing portion which includes a structure connector assembly which extends outward from an exterior portion of the back housing portion. A plurality of item pressing members are connected to an interior portion of the back housing portion. A front housing portion includes a housing connector for connecting the front housing portion to the back housing portion. The front housing portion includes a plurality of item retainers and a plurality of windows placed in registration with the item retainers. A plurality of infant stimulus items are retained in the item retainers. The item retainers are placed in registration with the item pressing members when the front housing portion and the back housing portion are placed in a closed orientation. A housing lock assembly is connected between the back housing portion and the front housing portion, for keeping the back housing portion and the front housing portion closed with respect to each other. The infant stimulus items can include stimulus cards. The stimulus cards include grab tabs located on back sides of the stimulus cards. The housing connector includes a hinge connected between an edge of the back housing portion and a complementary edge of the front housing portion.

The structure connector assembly includes two pairs of sets of vertical back straps connected to the back housing portion. Back-strap lock elements are connected to the sets of vertical back straps, wherein, for a set of the vertical back straps, the back-strap lock elements are complimentary and interconnect with each other. More specifically, for a set of vertical back straps, the back-strap lock elements preferably comprise complimentary male and female snap-together connectors, or alternatively, quantities of complimentary hook or loop material. The structure connector assembly preferably further includes a horizontal structure-connector strap assembly connected to the back housing portion.

Each of the item retainers includes a plurality of retention walls which are located on the front housing portion, such that the retention walls are located outside of the periphery of the windows. The edges of the front housing portion are used as the exterior retention walls for item retainers adjacent to the edges of the housing. Sets of four of the retention walls form four-sided item retainers, which facilitate suitable registration of a particular stimulus card with its corresponding window and constrain the stimulus cards from moving either left/right or up/down when the housing is in the closed position.

The front housing portion includes frame portions which periphery frame the openings defined by the windows. The frame portions are located between the windows and the retention walls. The frame portions function to constrain a card from moving out in forward direction through the openings defined by the windows. The item pressing members can include pressing walls which project from portions of the back housing to portions of the front housing. Sets of one, two, three or four pressing walls function to urge the stimulus cards snugly against corresponding frame portions. The pressing walls are nested within the retention walls when the back housing portion and the front housing portion are in a closed orientation, i.e. when the housing is in a closed condition the pressing walls press or urge the stimulus cards against corresponding confronting opposed engaged frame portions.

The front housing portion has a four-cornered perimeter. The back housing portion has a four-cornered perimeter. The back housing portion is nested with the front housing portion when the back housing portion and the front housing portion are in a closed orientation.

The housing lock assembly includes a key-operated tumbler lock assembly. The key-operated tumbler lock assembly includes a back-housing-portion-mounted bracket. A front-housing-portion-mounted tumbler unit engages the back-housing-portion-mounted bracket when the key-operated tumbler lock assembly is locked.

The housing lock assembly can include a release-pin-operated lock assembly. The release-pin-operated lock assembly includes a biased locking flange attached to the back housing portion. A fixed locking tab is attached to the front housing portion. A pin access channel is provided in the front housing portion, and an unlocking pin is inserted in the pin access channel for moving the biased locking flange away from the locking tab for unlocking the release-pin-operated lock assembly.

An electrical power and distribution system is supported by the back housing portion. The electrical power and distribution system includes a battery power supply, a plurality of positive electrical conductors connected to a positive terminal of the battery power supply, a plurality of positive electrical contacts connected to the positive electrical conductors, a plurality of negative electrical conductors connected to a negative terminal of the battery power supply, and a plurality of negative electrical contacts connected to the of negative electrical conductors. Electrical items include terminals which are placed in registration with respective pairs of the positive electrical contacts and the negative electrical contacts.

A lock-enabled electrical switch is located in series in the electrical power and distribution system. The lock-enabled switch includes a pair of electrical switch contacts on the back-housing-portion-mounted bracket. An electrical shunt is on the front-housing-portion-mounted tumbler unit.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved infant stimulus toy apparatus which has all of the advantages of the prior art and none of the disadvantages.

It is another object of the present invention to provide a new and improved infant stimulus toy apparatus which may be easily and efficiently manufactured and marketed.

It is a further object of the present invention to provide a new and improved infant stimulus toy apparatus which is of durable and reliable construction.

An even further object of the present invention is to provide a new and improved infant stimulus toy apparatus which is susceptible of a low cost of manufacture with regard to both materials and labor, and which accordingly is then susceptible of low prices of sale to the consuming public, thereby making such improved infant stimulus toy apparatus available to the buying public.

Still yet a further object of the present invention is to provide a new and improved infant stimulus toy apparatus which places stimulus items in the front portion of the device.

Still another object of the present invention is to provide a new and improved infant stimulus toy apparatus that provides a tight fit on stimulus cards when the device is closed.

Yet another object of the present invention is to provide a new and improved infant stimulus toy apparatus which can tilt stimulus items downward to enable infants laying down in a crib to see the stimulus items.

Even another object of the present invention is to provide a new and improved infant stimulus toy apparatus that provides a device in which stimulus cards can be removed without grasping the edges or fronts of the cards.

Still a further object of the present invention is to provide a new and improved infant stimulus toy apparatus which provides a central power supply and distribution system for all electronic devices that are employed in the device.

Yet another object of the present invention is to provide a new and improved infant stimulus toy apparatus that prevents batteries from discharging once an infant stimulus toy apparatus is opened.

Still another object of the present invention is to provide a new and improved infant stimulus toy apparatus which requires the use of some sort of removable key to open the device.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 7 is a drawing wherein an electrical diagram of the electrical components of the preferred embodiment of the invention is depicted, and wherein a key-operated lock for the apparatus is provided.

FIG. 8 is an enlarged, partially exploded, cross-sectional view of the embodiment of the invention shown in FIG. 7 taken along line 8—8 thereof.

FIG. 11 is a schematic electrical diagram of an alternative electrical power distribution switch circuit used with the present invention.

FIG. 12 is a partial perspective view of the front housing portion and the back housing portion incorporating the electric switch circuit portion of FIG. 12.

DESCRIPTION OF THE PREFERRED EMBODIMENT

Figure 1:
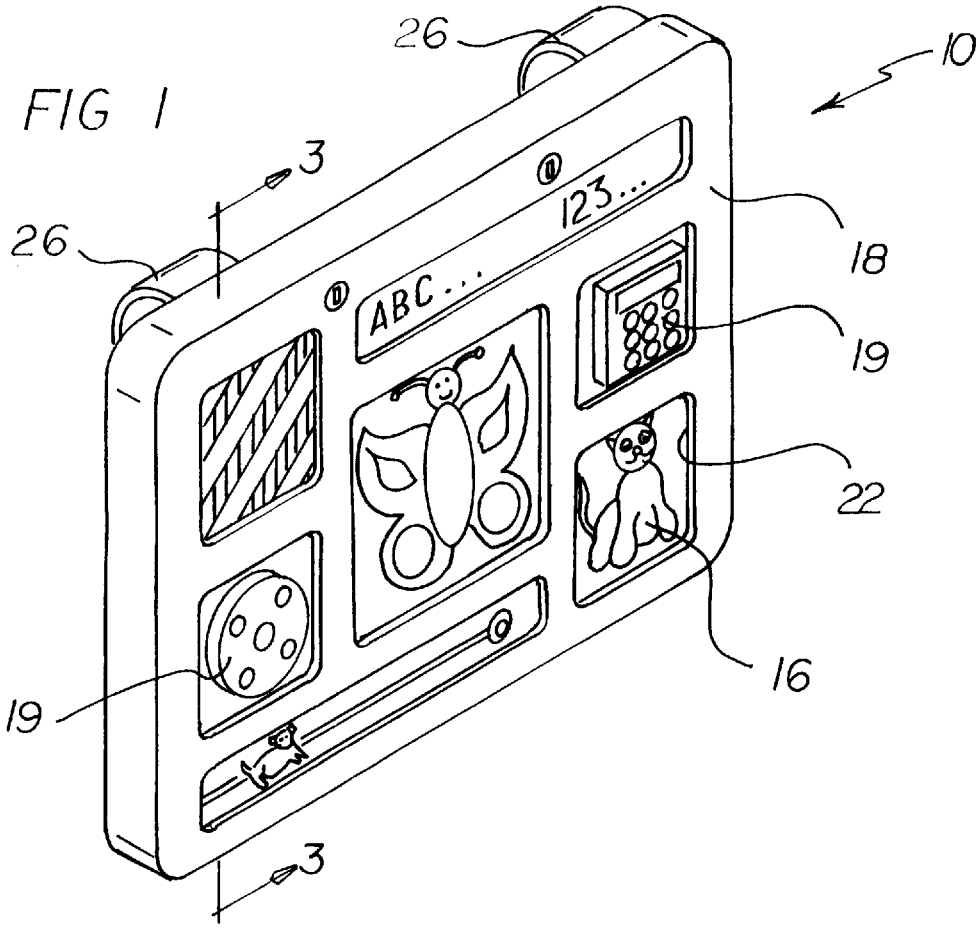
FIG. 1 is a perspective view showing a preferred embodiment of the improved infant stimulus toy apparatus of the invention in a closed condition and containing a number of items inside the apparatus.
Figure 2:
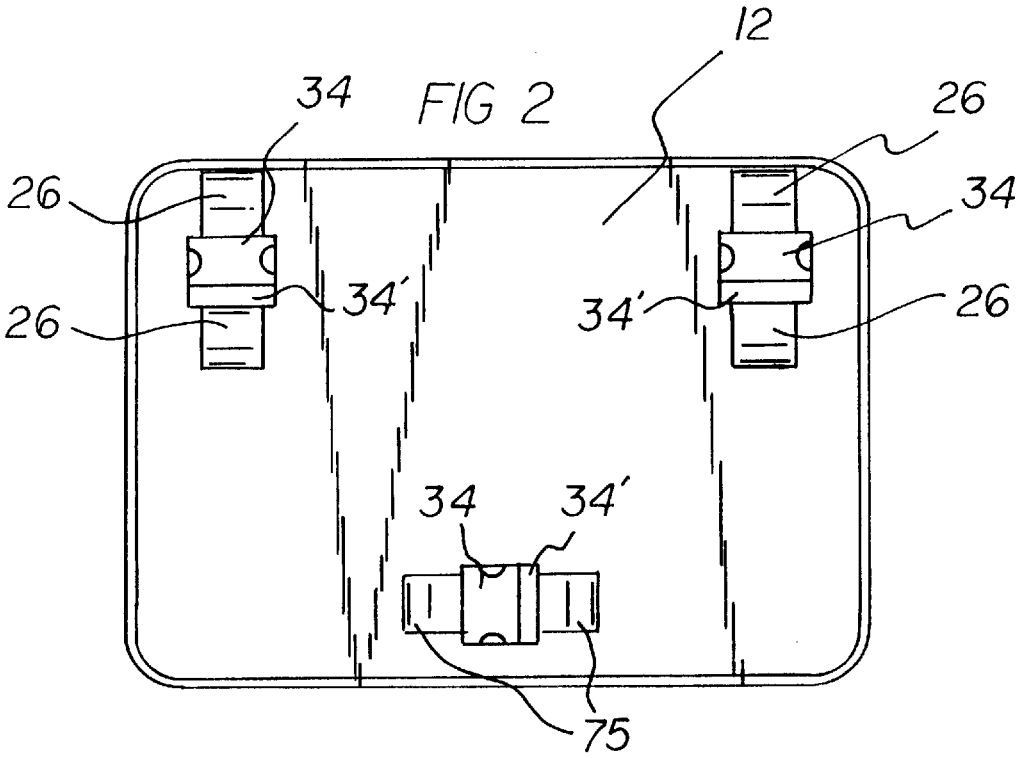
FIG. 2 is a rear view of the embodiment of the improved infant stimulus toy apparatus shown in FIG. 1.

With reference to the drawings, a new and improved infant stimulus toy apparatus embodying the principles and concepts of the present invention will be described.

Turning to FIGS. 1–13, there is shown an exemplary embodiment of the improved infant stimulus toy apparatus of the invention generally designated by reference numeral 10. In its preferred form, improved infant stimulus toy apparatus 10 includes a back housing portion 12 which includes a structure connector assembly which extends outward from an exterior portion of the back housing portion 12. A plurality of item pressing members are connected to an interior portion of the back housing portion 12. A front housing portion 18 includes a housing connector for connecting the front housing portion 18 to the back housing portion 12. The front housing portion 18 includes a plurality of item retainers and a plurality of windows 22 placed in registration with the item retainers. A plurality of infant stimulus items 16 are retained in the item retainers. The item retainers are placed in registration with the item pressing members when the front housing portion 18 and the back housing portion 12 are placed in a closed orientation. A housing lock assembly is connected between the back housing portion 12 and the front housing portion 18, for keeping the back housing portion 12 and the front housing portion 18 securely closed with respect to each other. The infant stimulus items can include stimulus cards 16. The stimulus cards 16 can include grab tabs 17 located on back sides of the stimulus cards 16. The housing connector includes a hinge 21 connected between an edge of the back housing portion 12 and a complementary edge of the front housing portion 18.

The structure connector assembly includes two pairs of sets of vertical back flexible straps 26 connected to the back housing portion 12. Back-strap lock elements 34, 34' are connected to the sets of vertical back straps 26, wherein, for a set of the vertical back straps 26, the back-strap lock elements are complimentary and interconnect with each other. More specifically, for a set of vertical back straps 26, the back-strap lock elements 34, 34' preferably include a pair of complimentary male and female snap-together plastic or metal connectors, respectively, such as are well known in the art of selectively connecting and disconnecting a pair of strap or web members. The straps 26 are adjustable in a known manner with respect to either or both of male or female connectors 34, 34' to permit adjustment of the effective length of the straps relative to supporting structure. Alternatively, back straps 26 may be selectively adjustably connected and disconnected with respect to each other by quantities of complimentary hook or loop material such as that sold under the well-known trademark VELCRO®. The structure connector assembly preferably further includes a horizontal structure-connector strap assembly featuring a pair of horizontally oriented straps 75 connected to the back housing portion 12.

Each of the item retainers includes a plurality of retention walls 39 which are located on the front housing portion 18, such that the retention walls 39 are located outside (laterally beyond) the periphery of the windows 22 substantially as shown. Sets of up to four of the retention walls 39 form corresponding multiple-sided item retainers corresponding to each opening defined by a window 22.

The front housing portion 18 includes frame portions 66 which frame the windows 22 (or the openings defined thereby). The frame portions 66 are located between the windows 22 and the retention walls 39 (see FIGS. 5 and 6). The item pressing members include pressing walls 38 which project inward from the back housing portion 12. Sets of one, two, three or four pressing walls 38 form up to four-sided individual item pressers. The pressing walls 38 are nested within corresponding retention walls 39 when the back housing portion 12 and the front housing portion 18 are in a closed orientation, and the pressing walls 38 press items 16 against the frame portions 66 when the back housing portion 12 and the front housing portion 18 are in a closed orientation.

The pressing of items (e.g. stimulus cards) against the frame portions 66 assures a secure positioning of the items and prevents an infant's fingers from dislodging the items. Adjacent pressing walls 38 of adjacent multiple-sided item pressers straddle retention walls 39 when the back housing portion 12 and the front housing portion 18 are in a closed orientation.

In order to prevent interference between the pressing walls 38 and retention walls 39 along the bottom-most portion of the housing proximal to hinge assembly 21, fixed relatively flat tabs 40 preferably are used as bottom-most retainers (in lieu of a pair of pressing walls engaging a retainer member 39) substantially as shown in FIGS. 3–6. The tabs 40 serve as a retainer fence along the bottom edge of all stimulus items located in the bottom-most row of windows 22 in which case the items are retained by the tabs and three-sided pressing walls engaging three-sided retainers, respectively.

The front housing portion 18 has a four-cornered perimeter. The back housing portion 12 has a four-cornered perimeter. The back housing portion 12 is nested with the front housing portion 18 when the back housing portion 12 and the front housing portion 18 are in a closed orientation.

As shown in FIG. 8, the housing lock assembly includes a key-operated tumbler lock assembly. The key-operated tumbler lock assembly includes a back-housing-portion-mounted bracket 50. A front-housing-portion-mounted tumbler unit 52 which engages the back-housing-portion-mounted bracket 50 when the key-operated tumbler lock assembly is locked.

Figure 9:
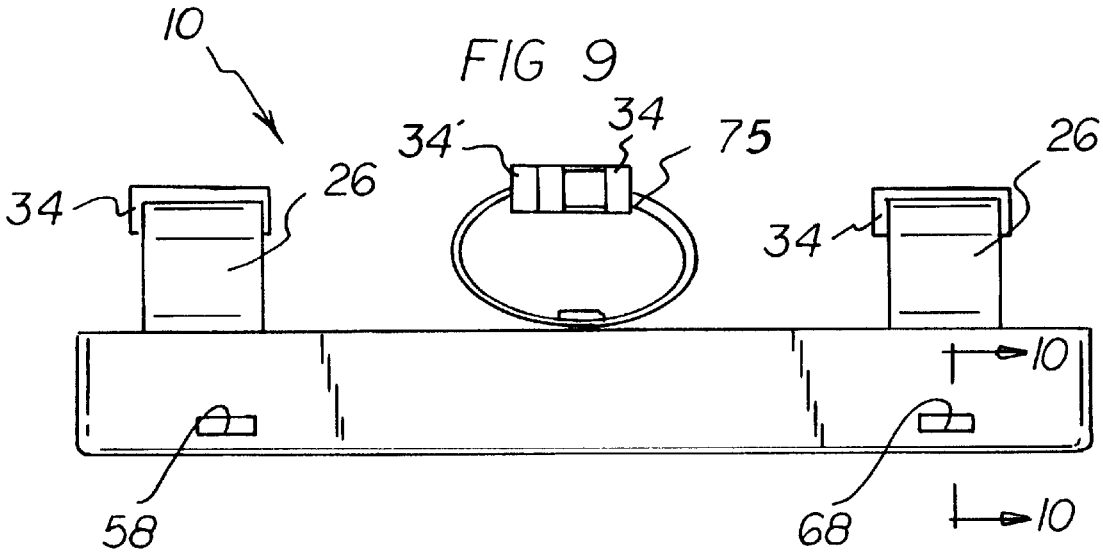
FIG. 9 is a top view of an embodiment of the invention in which a lock is provided that includes locking barbs on a resilient locking member.
Figure 10:
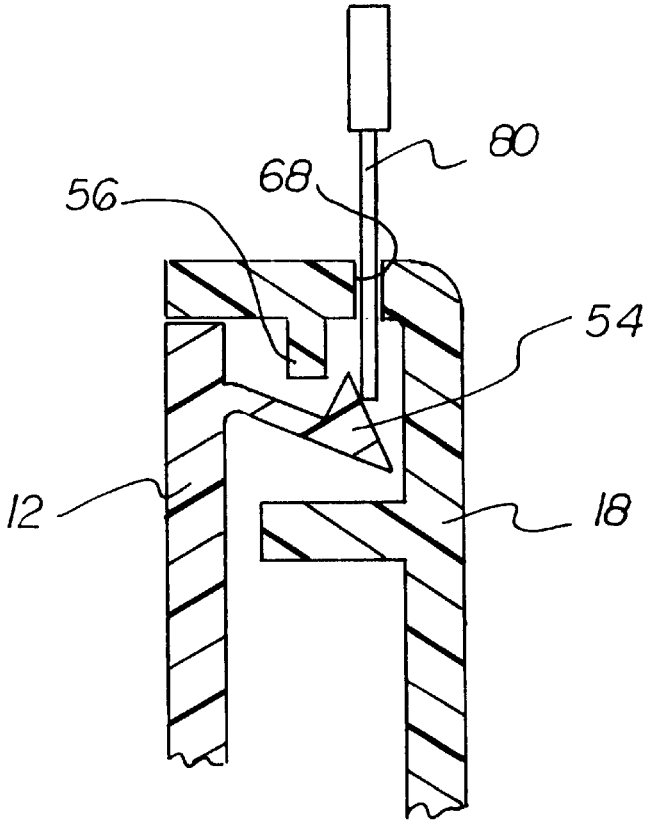
FIG. 10 is an enlarged cross-sectional view of the embodiment of the invention shown in FIG. 9 taken along line 10—10 thereof.

Alternatively, as shown in FIGS. 9 and 10, the housing lock assembly can include a release-pin-operated lock assembly. The release-pin-operated lock assembly includes a biased locking flange 54 attached to the back housing portion 12. A fixed locking tab 56 is attached to the front housing portion 18. A pin access channel 68 is provided in the front housing portion 18, and an unlocking pin 80 is inserted in the pin access channel 68 for moving the biased locking flange 54 away from the locking tab 56 for unlocking the release-pin-operated lock assembly. In the locked condition, the flange 54 is normally biased into an upward (FIG. 10) position engaging the tab 56.

As shown in FIGS. 7 and 8, an electrical power and distribution system is supported by the back housing portion 12. The electrical power and distribution system includes a battery power supply 89, a plurality of positive electrical conductors 58 connected to a positive terminal of the battery power supply 89, a plurality of positive electrical contacts 60 connected to the positive electrical conductors 58, a plurality of negative electrical conductors 62 connected to a negative terminal of the battery power supply 89, and a plurality of negative electrical contacts 64 connected to the of negative electrical conductors 62. Electrical items 19 include terminals which are placed in registration with respective pairs of the positive electrical contacts 60 and the negative electrical contacts 64.

A lock-enabled electrical switch is located in series in the electrical power and distribution system. For the key-operated tumbler lock assembly, The lock-enabled switch includes a pair of electrical switch contacts 67 on the back-housing-portion-mounted bracket 50. An electrical shunt 69 is on the front-housing-portion-mounted tumbler unit 52. As will be explained in more detail below, when the electrical shunt is in the position shown in FIG. 8, an electrical power circuit is completed through switch contacts 67 thereby electrically energizing the electrical items 19 only when the housing is in the closed locked condition. Similarly, when the key-operated tumbler lock assembly is opened by use of key 51, shunt 69 is rotated out of contact between switch contacts 67 thereby opening or disenabling the power distribution circuit. In this manner, opening of the housing by operation of the key-operated tumbler lock assembly simultaneously and automatically deenergizes the electrical items 19.

Nonetheless, it will be appreciated that In carrying out the present invention, it is not necessary to combine the "locking" of the housing with the enablement/disenablement of the electrical power distribution circuit as these functions may be carried out independently, if desired. Thus, an alternative "contact-enabled" power disabling safeguard means is schematically shown in FIGS. 11 and 12 wherein a pair of normally open spaced electrical switch contacts 70 are located on the inside surface 72 of top edge portion 74 of front housing portion 18. The contacts 70 are in an electrical circuit between battery supply 89 and the positive conductors 58. A bridging circuit comprising similarly spaced electrical contacts 76 connected by shunt conductor 78 are located on top edge surface 80 of top edge portion 82 of back housing portion 12. By this arrangement, an electrical power distribution circuit can only be completed when the spaced bridging electrical switch contacts 76 (back housing portion 12)_are in registration with the electrical switch contacts 70 (front housing portion 18) and such registration will be effected only when the back housing portion and the front housing portion are in the closed condition. Thus, opening and closing of the housing automatically disenables and enables, respectively, the electrical power distribution circuit. For illustration purposes, the foregoing alternatively preferred electrical power distribution enable/disenable feature is described herein in connection with the "positive" leads 58. Nonetheless, if desired, the alternative "contact-enabled" power disabling safeguard means of FIG. 11 instead may be provided between the battery power supply 89 and the plurality of "negative" electrical conductors 62.

The vertical back straps 26 and the horizontal structure-connector strap assembly 75 are used to connect the toy apparatus 10 of the invention to a crib, playpen, car setback, or other infant area in manner believed apparent to person of ordinary skill.

Figures 3, 4:
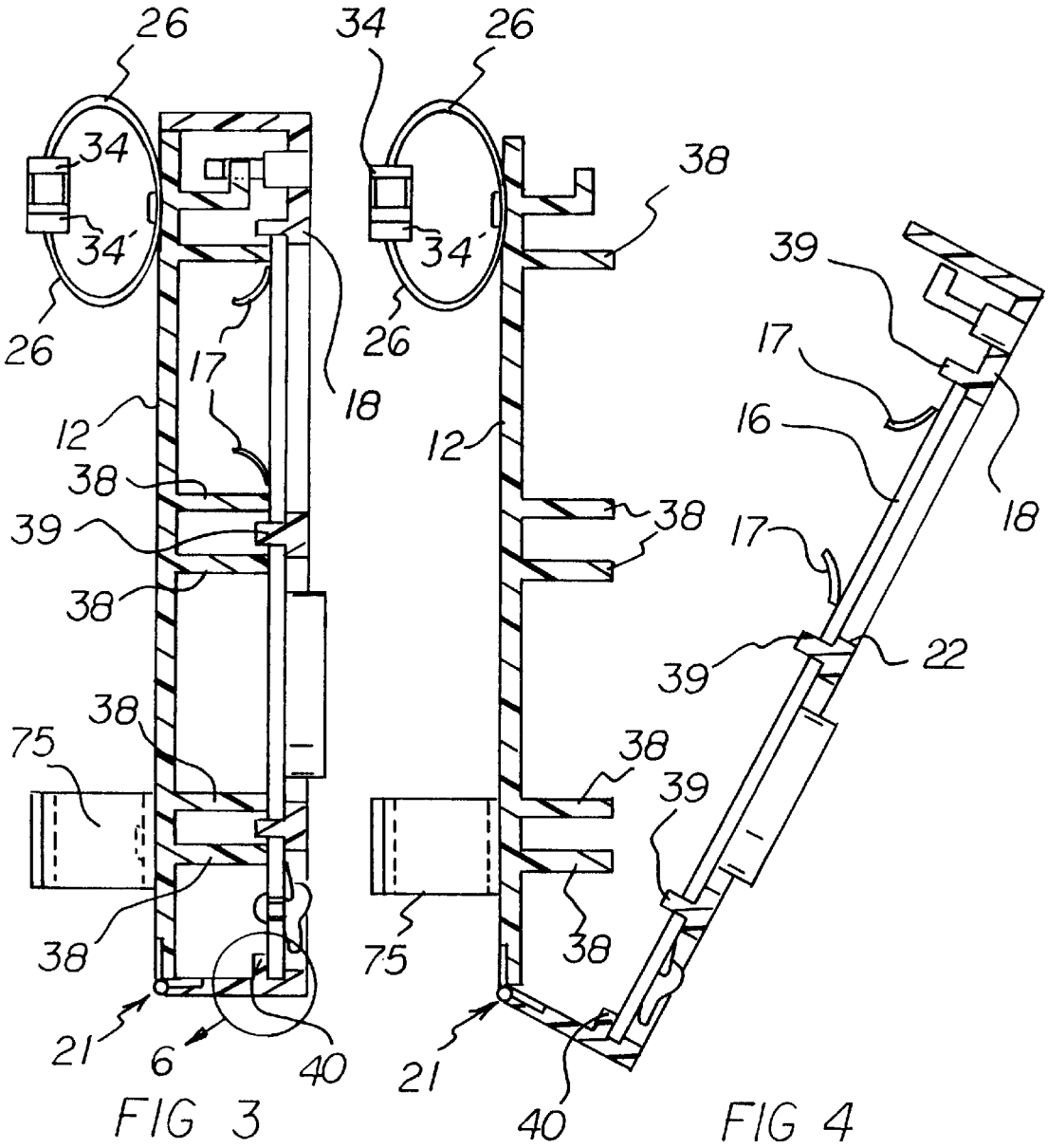
FIG. 3 is an enlarged cross-sectional view of the embodiment of the improved infant stimulus toy apparatus of FIG. 1 taken along line 3—3 thereof.
FIG. 4 is a cross-sectional view of the embodiment of the invention shown in FIG. 3 with the front and back portions opened with respect to each other.
Figure 5:
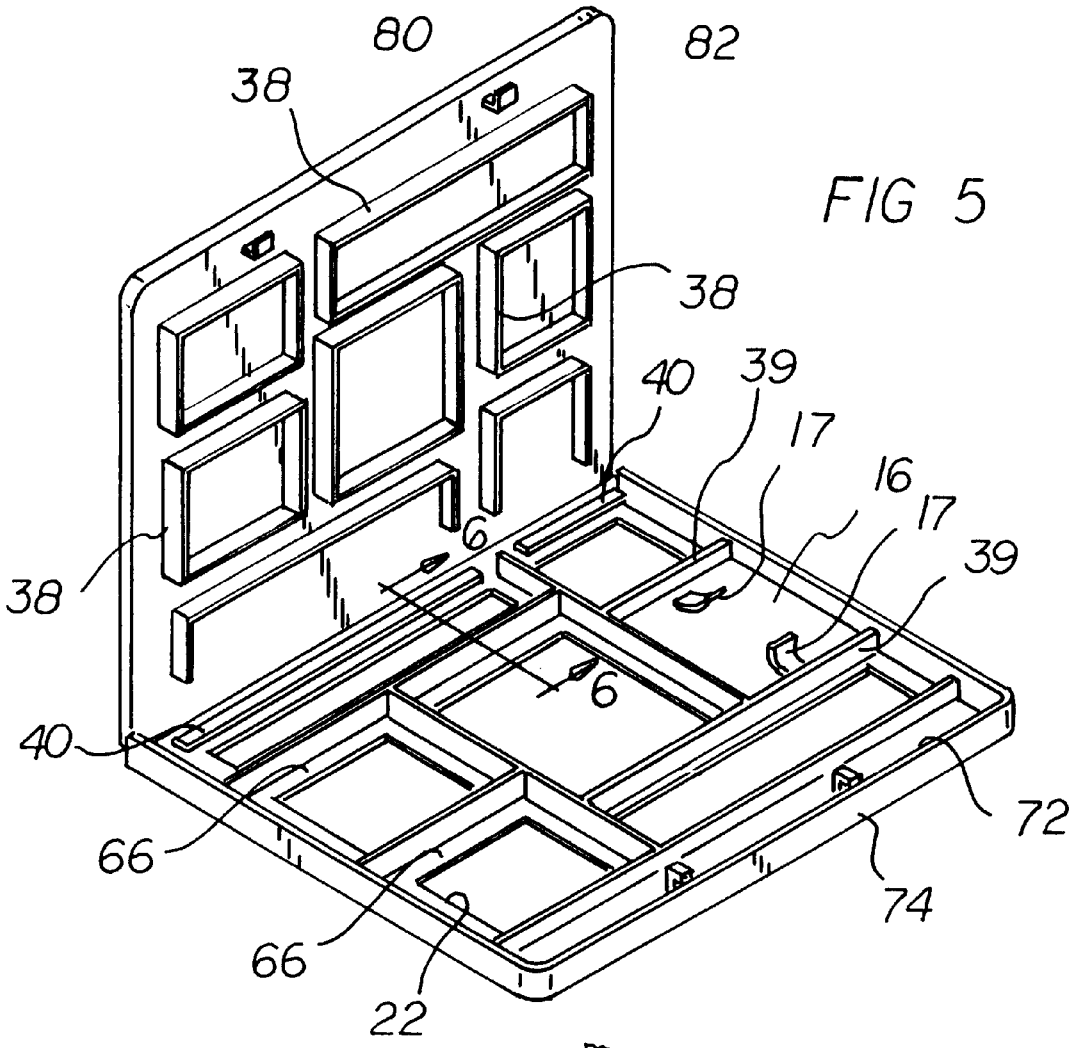
FIG. 5 is a perspective view of the embodiment of the invention shown in FIG. 1 in an open condition with items removed from inside the apparatus.
Figure 6:
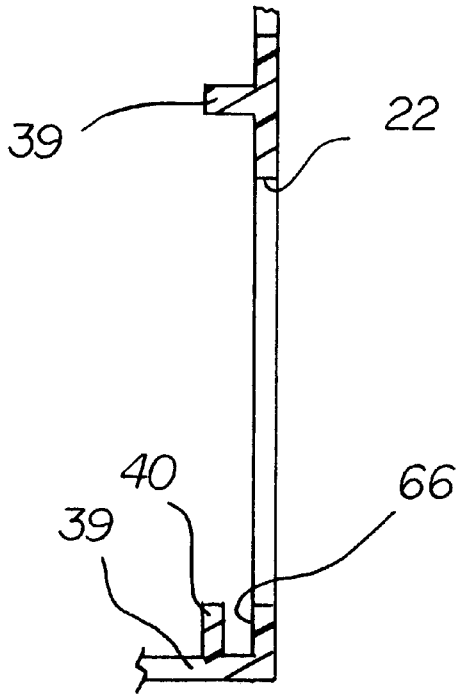
FIG. 6 is a partial cross-sectional view of the embodiment of the invention shown in FIG. 5 taken along line 6—6 thereof.

To use non-electrical items 16 in the toy apparatus 10 of the invention, the back housing portion 12 and the front housing portion 18 are placed in an open orientation, such as shown in FIGS. 4, 5, and 7 and as explained below. Items 16, such as stimulus cards which have grab tabs 17 on the back, are placed up against the frame portions 66 so that the stimulus cards can be seen through the windows 22. Then, the back housing portion 12 and the front housing portion 18 are swung together around the hinge 21. When the back housing portion 12 and the front housing portion 18 are in the closed orientation, the pressing walls 38 press the stimulus cards against the frame portions 66, whereby the items 16 are secured to be visible from the windows 22. When it is desired to remove or change stimulus cards, the back housing portion 12 and the front housing portion 18 are moved to an open orientation, and the grab tabs 17 are grabbed to pull the items 16 away from the frame portions 66 and the front housing portion 18. In the bottom-most row, the bottom edge of items 16 may be first placed between tab 40 and the frame portion 66 confronting the tab (see FIG. 6), and then the remainder of the card is placed against the frame portions 66 common to the three-sided pressing walls engaging the three-sided retainers, respectively, To use electrical items 19 with the toy apparatus 10 of the invention, the back housing portion 12 and the front housing portion 18 are placed in an open condition. Electrical items 19, such as shown in FIG. 1, are placed between retention walls 39 and against frame portions 66 so that the front portions of the electrical items 19 project through respective windows 22. When the back housing portion 12 and the front housing portion 18 are then closed, a pair of electrical contacts, includes one positive electrical contact 60 and one negative electrical contact 64, is placed in contact with electrical contacts on the back portion of each respective electrical item 19.

As shown in FIG. 8, the distribution of electrical power may be controlled by the status of the key-operated tumbler lock assembly. In addition, the back housing portion 12 and the front housing portion 18 are mechanically locked in the closed orientation by the back-housing-portion-mounted bracket 50 and the front-housing-portion-mounted tumbler unit 52. More specifically, a key 51 is used to operate the front-housing-portion-mounted tumbler unit 52. When the front-housing-portion-mounted tumbler unit 52 is in an unlocked position, the front-housing-portion-mounted tumbler unit 52 is disengaged from the back-housing-portion-mounted bracket 50, and the electrical shunt 69 is moved out of contact with the pair of electrical switch contacts 67. The pair of electrical switch contacts 67 and the electrical shunt 69 form a switch in series in the electrical power distribution system. Therefore, when the switch is in an open condition, such as just described, the electrical power distribution system is in an open circuit condition. In this way, the key-operated tumbler lock assembly serves to prevent battery discharge when the back housing portion 12 and the front housing portion 18 are in an open orientation.

On the other hand, when the back housing portion 12 and the front housing portion 18 are in a closed, locked orientation, the electrical shunt 69 is in contact with the pair of electrical switch contacts 67, whereby the switch is in a closed condition. In the closed condition, electrical power is supplied to the electrical power distribution system.

Alternatively, as shown in FIGS. 9 and 10, a release-pin-operated lock assembly is provided. When the back housing portion 12 and the front housing portion 18 are in the closed orientation, the biased locking flange 54 of the back housing portion 12 is in engagement with the locking tab 56 of the front housing portion 18, whereby the back housing portion 12 and the front housing portion 18 are locked in the closed orientation. When the unlocking pin 80 is pushed through the pin access channel 68, the unlocking pin 80 pushes the biased locking flange 54 away from the locking tab 56, whereby the release-pin-operated lock assembly is unlocked, and the back housing portion 12 and the front housing portion 18 can be moved away from each other in an open orientation. The biased locking flange 54 has a resilient connection with the back housing portion 12. The alternative "contact-enabled" power disabling safeguard means is schematically shown in FIGS. 11 and 12 may advantageously be used with release-pin-operated lock assembly of FIGS. 9 and 10.

Figure 13:
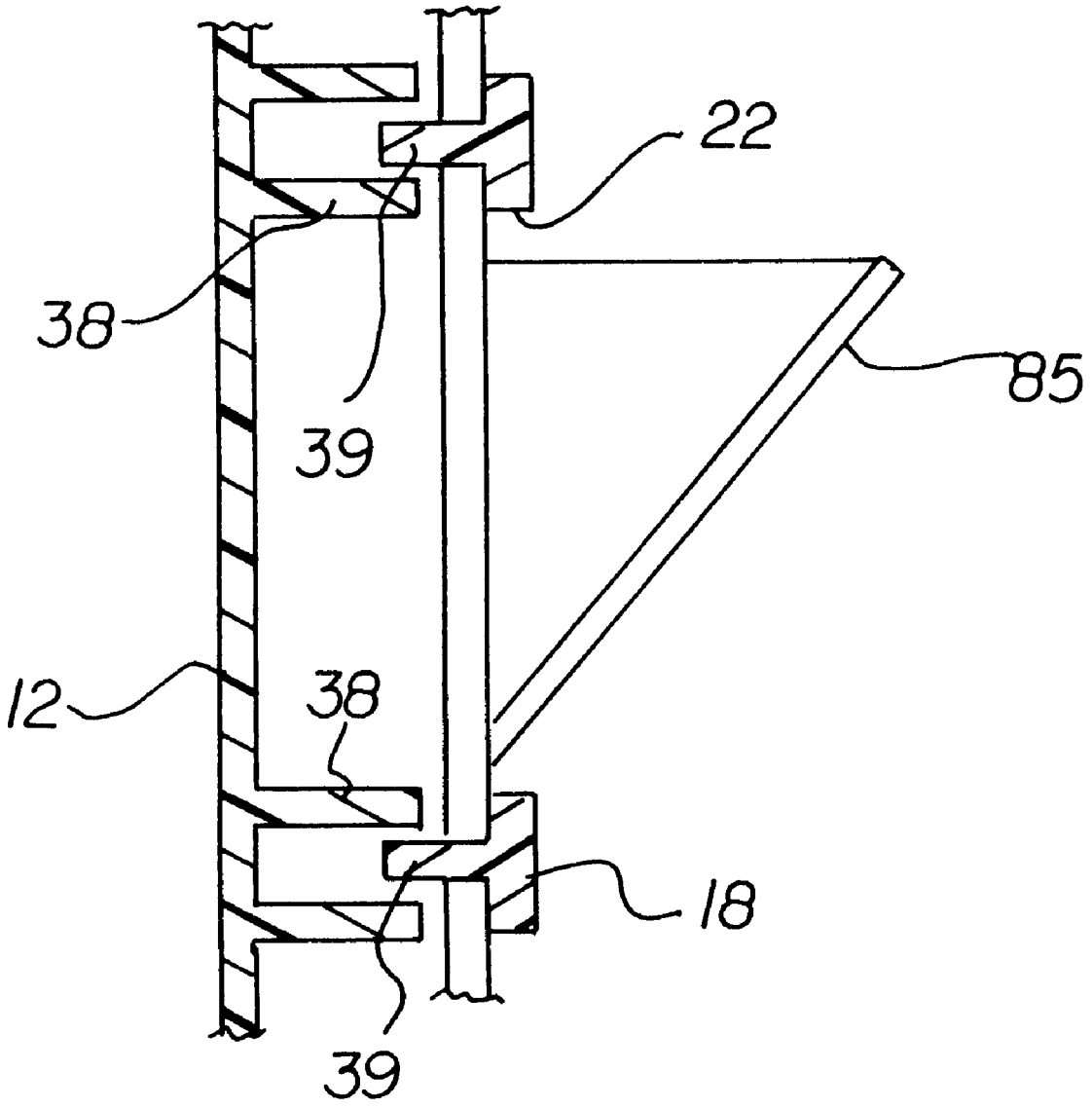
FIG. 13 is a partial cross-sectional view of an alternative embodiment showing a stimulus card with a tilted or angular surface.

If desired, as substantially shown in FIG. 13, stimulus cards can be provided with faces 85 tilted or angled downward to enable infants laying down in a crib to see the stimulus cards. Besides using the pressing walls 38 and the frame portions 66 for securing stimulus cards 16 and other items tightly to the front housing portion 18, alternative structures can be used. For example, rotating tabs which slide over the edges of items can be used. Also, fixed tabs (similar to tabs, shoulders, or flanges (similar to tabs 40) can be provided on the front housing portion 18, and the item can be bent slightly for its insertion therein. Also, twist-lock devices can be used which poke through holes in the items can be used, and the twist-lock devices can be turned to lock the items in place. Still alternatively, magnetic strips and hook and loop fasteners can be employed. Combinations of these alternative methods may reduce or eliminate the required number of pressing walls 38 needed to securely hold the cards against the framing portions 66 on the front housing portion 18.

The components of the improved infant stimulus toy apparatus of the invention can be made from inexpensive and durable metal, wood or plastic materials, or combinations thereof.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved infant stimulus toy apparatus that is low in cost, relatively simple in design and operation, and which may advantageously place stimulus items in the front portion of the device. With the invention, an improved infant stimulus toy apparatus provides a tight fit on stimulus cards when the device is closed. With the invention, an improved infant stimulus toy apparatus is provided which can tilt stimulus items downward to enable infants laying down in a crib to see the stimulus items. With the invention, an improved infant stimulus toy apparatus provides a device in which stimulus cards can be removed without grasping the edges or fronts of the cards. With the invention, an improved infant stimulus toy apparatus provides a central power supply and distribution system for all electronic devices that are employed in the device. With the invention, an improved infant stimulus toy apparatus is provided which prevents batteries from discharging once an infant stimulus toy apparatus is opened. With the invention, an improved infant stimulus toy apparatus is provided which requires to use of some sort of removable key to open the device.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A toy apparatus, comprising:

a back housing portion which includes a structure connector assembly which extends outward from an exterior portion of said back housing portion, a plurality of item pressing members connected to an interior portion of said back housing portion, a front housing portion which includes a housing connector for connecting said front housing portion to said back housing portion, wherein said front housing portion includes a plurality of item retainers and a plurality of windows placed in registration with said item retainers, a plurality of items retained in said item retainers, wherein said item retainers are placed in registration with said item pressing members when said front housing portion and said back housing portion are placed in a closed orientation, and a housing lock assembly, connected between said back housing portion and said front housing portion, for keeping said back housing portion and said front housing portion closed with respect to each other, wherein said housing lock assembly further includes an electrical power and distribution system supported by said back housing portion, and a lock-enabled switch located in series in said electrical power and distribution system.

2. The apparatus of claim 1 wherein each of said item retainers includes a plurality of retention walls which are located on said front housing portion such that said retention walls are located outside of said windows, wherein said front housing portion includes frame portions which frame said windows, wherein said retention walls are nested with respect to said pressing walls when said back housing portion and said front housing portion are in a closed orientation, and said pressing walls press items against said frame portions when said back housing portion and said front housing portion are in a closed orientation, and wherein said items include stimulus cards.

3. The apparatus of claim 1 wherein said items include stimulus cards.

4. The apparatus of claim 2 wherein said stimulus cards include grab tabs located on back sides of said stimulus cards.

5. The apparatus of claim 2 wherein said structure connector assembly includes:

two pairs of sets of vertical back straps connected to said back housing portion, and back-strap lock elements connected to said sets of vertical back straps, wherein, for a set of said vertical back straps, said back-strap lock elements are complimentary and interconnect with each other.

6. The apparatus of claim 5 wherein:

said back-strap lock elements are selected from the group comprising connectable and disconnectable male and female snap connectors or hook or loop material, attached respectively to said pair of vertical back straps.

7. The apparatus of claim 5 wherein said structure connector assembly further includes a horizontal structure-connector strap assembly connected to said back housing portion.

8. The apparatus of claim 2 wherein sets of four of said retention walls form four-sided item retainers.

9. The apparatus of claim 2 wherein said frame portions are located between said windows and said retention walls.

10. The apparatus of claim 2 wherein sets of four of said pressing walls form four-sided item pressers.

11. The apparatus of claim 2 wherein adjacent pressing walls of adjacent four-sided item pressers straddle retention walls when said back housing portion and said front housing portion are in a closed orientation.

12. The apparatus of claim 2 wherein:

said front housing portion has a four-cornered perimeter, said back housing portion has a four-cornered perimeter, and said back housing portion is nested with said front housing portion when said back housing portion and said front housing portion are in a closed orientation.

13. The apparatus of claim 2 wherein said housing lock assembly includes a key-operated tumbler lock assembly.

14. The apparatus of claim 13 wherein said key-operated tumbler lock assembly includes:

a back-housing-portion-mounted bracket, and a front-housing-portion-mounted tumbler unit which engages said back-housing-portion-mounted bracket when said key-operated tumbler lock assembly is locked.

15. The apparatus of claim 2 wherein said housing lock assembly includes a release-pin-operated lock assembly.

16. The apparatus of claim 15 wherein said release-pin-operated lock assembly includes:

a biased locking flange attached to said back housing portion, a fixed locking tab attached to said front housing portion, a pin access channel in said front housing portion, and an unlocking pin which can be inserted in said pin access channel for moving said biased locking flange away from said locking tab for unlocking said release-pin-operated lock assembly.

17. The apparatus of claim 1 wherein said electrical power and distribution system includes:

a battery power supply, a plurality of positive electrical conductors connected to a positive terminal of said battery power supply, a plurality of positive electrical contacts connected to said positive electrical conductors, a plurality of negative electrical conductors connected to a negative terminal of said battery power supply, and a plurality of negative electrical contacts connected to said of negative electrical conductors.

18. The apparatus of claim 17 wherein said items include electrical items which include terminals which are placed in registration with respective pairs of said positive electrical contacts and said negative electrical contacts.

19. The apparatus of claim 1 wherein said lock-enabled switch includes:

a pair of electrical switch contacts on said back housing portion and an electrical shunt on said front housing portion for bridging said pair of electrical switch contacts when said front housing portion and said back housing portion are placed in said closed orientation.

20. The apparatus of claim 2 wherein sets of three of said pressing walls form three-sided item pressers.

21. The apparatus of claim 20 wherein at least one of said three-sided item pressers further includes a fourth fixed tab associated therewith.

22. A toy apparatus, comprising:

a back housing portion which includes a structure connector assembly which extends outward from an exterior portion of said back housing portion, a plurality of item pressing members connected to an interior portion of said back housing portion, a front housing portion which includes a housing connector for connecting said front housing portion to said back housing portion, wherein said front housing portion includes a plurality of item retainers and a plurality of windows placed in registration with said item retainers, a plurality of items retained in said item retainers, wherein said item retainers are placed in registration with said item pressing members when said front housing portion and said back housing portion are placed in a closed orientation, and a housing lock assembly, connected between said back housing portion and said front housing portion, for keeping said back housing portion and said front housing portion closed with respect to each other, wherein said housing lock assembly further includes an electrical power and distribution system supported by said back housing portion, and contact-enabled switching means between the front housing portion and the back housing portion for interrupting said electrical power distribution system upon relative movement between said front housing portion and said back housing portion.

* * * * *